US009242247B2

(12) United States Patent
Lafond et al.

(10) Patent No.: US 9,242,247 B2
(45) Date of Patent: Jan. 26, 2016

(54) REPLACEABLE WEAR PARTS FOR AN EARTH-WORKING ROLL

(71) Applicant: ESCO Corporation, Portland, OR (US)

(72) Inventors: Stephen M. Lafond, Millet (CA); Cameron R. Leedham, Edmonton (CA); Christopher M. Carpenter, Tualatin, OR (US); Dallas Chapple, Edmonton (CA)

(73) Assignee: ESCO Corporation, Portland, OR (US)

( * ) Notice: Subject to any disclaimer, the term of this patent is extended or adjusted under 35 U.S.C. 154(b) by 0 days.

(21) Appl. No.: 14/050,268

(22) Filed: Oct. 9, 2013

(65) Prior Publication Data

US 2014/0034765 A1 Feb. 6, 2014

Related U.S. Application Data

(63) Continuation of application No. PCT/US2012/033690, filed on Apr. 13, 2012.

(60) Provisional application No. 61/475,963, filed on Apr. 15, 2011.

(51) Int. Cl.
*B02C 4/30* (2006.01)
*B02C 4/08* (2006.01)

(52) U.S. Cl.
CPC . *B02C 4/305* (2013.01); *B02C 4/08* (2013.01); *B02C 4/30* (2013.01)

(58) Field of Classification Search
CPC ..... E02F 9/2825; E02F 9/2833; E02F 9/2858; E02F 9/2866; E02F 9/2883; B02C 4/08; B02C 4/305; B02C 4/30
USPC ..... 172/540, 772; 37/452, 453, 454, 455, 37/456; 404/121, 124; 299/104, 106
See application file for complete search history.

(56) References Cited

U.S. PATENT DOCUMENTS

| | | | | |
|---|---|---|---|---|
| 5,653,048 | A | 8/1997 | Jones et al. | |
| 5,722,607 | A | 3/1998 | Helimich | |
| 6,393,739 | B1 * | 5/2002 | Shamblin et al. | 37/456 |
| 6,729,052 | B2 * | 5/2004 | Ollinger, IV et al. | 37/452 |
| 7,165,347 | B2 * | 1/2007 | Ollinger, IV et al. | 37/452 |
| 7,377,459 | B2 | 5/2008 | Potts | |
| 7,690,136 | B2 * | 4/2010 | Breken | 37/452 |
| 7,730,645 | B2 * | 6/2010 | Ollinger, IV | 37/328 |
| 8,024,874 | B2 * | 9/2011 | McClanahan et al. | 37/452 |
| 8,333,439 | B2 * | 12/2012 | Gibbins | 301/44.1 |
| 8,814,073 | B2 | 8/2014 | Barber | |
| 2004/0000606 | A1 | 1/2004 | Diemunsch | |
| 2006/0255653 | A1 * | 11/2006 | Gibbins | 301/43 |
| 2007/0051022 | A1 | 3/2007 | Meyers et al. | |
| 2008/0005940 | A1 * | 1/2008 | Ollinger | 37/452 |
| 2009/0174252 | A1 | 7/2009 | Morris et al. | |
| 2009/0217556 | A1 | 9/2009 | McClanahan | |
| 2013/0174453 | A1 * | 7/2013 | Cheyne et al. | 37/453 |

* cited by examiner

*Primary Examiner* — Jamie L McGowan
(74) *Attorney, Agent, or Firm* — Steven P. Schad

(57) ABSTRACT

A wear assembly for use on a driven roll for earth-working machines and the like operations that eases replacement of the wear parts, lengthens the life of the bases, reduces the amount of throw-away material to be discarded, and has a lower manufacturing cost. The wear part overlies and protects the base to prolong the useable life of the base, lessen machine downtime, and reduce throw-away material. The use of an overlying adapter eases and speeds replacement of the wear parts to further limit downtime of the machine. The wear part is preferably a two-piece component with no machined parts for a lower manufacturing cost and easy replacement.

16 Claims, 17 Drawing Sheets

REPLACEABLE WEAR PARTS FOR AN EARTH-WORKING ROLL

FIELD OF THE INVENTION

The present invention pertains to replaceable wear parts for an earth-working roll such as used in a roll crusher, surface miner, underground mining machine, milling machines, feeding machines, and the like.

BACKGROUND OF THE INVENTION

Crushers are used in mining operations to reduce the size of the mined material. In one example of a mining operation (FIG. 30), mined material 1 is dumped into a chute 3 and directed onto a conveyor 5 for transport to a roll crusher 7. The roll crusher 7 in this example is a double roll crusher, which includes a pair of opposed rolls 9 to break up the mined material 1. Each roll 9 is fitted with an array of tips 11 adapted to engage the mined material and break it up (FIG. 31). The tips are secured to bases or holders 13 that are fixed to the rolls 9. The rolls 9 are rotated in opposite directions so that the tips 11 are driven toward each other from the top. The broken material 1A passing through the roll crusher 7 is deposited on a second conveyor 17 for transport to rotary screens 19 for separation of the material.

In a conventional machine, tip 11 is a one-piece member that includes a mounting shaft 21 for attachment to a holder 13, and a cone 23 for engaging the mined material 1 (FIGS. 32-34). Mounting shaft 21 is machined to fit into a machined bore 24 in base 13 to retain the tip in the base, properly orient the tip, and provide sufficient support during use. The use of a machined bore and shaft, however, leads to increased manufacturing costs. Further, fines commonly get embedded in the bore around the shaft during use, which can make the tip difficult to remove from the base.

Further, cone 23 and base 13 suffer considerable abuse and wear during use. Because of the severity of the crushing operation, the tips and bases need regular replacement even with hardfacing and proper maintenance. Moreover, even though only the cone of the tip may be worn out, the entire tip must be replaced. Likewise, even though only the top of the base may be worn out due to the greater exposure during use, the entire base must be replaced. The construction results in a considerable amount of throw-away material. In addition, replacing the tips 11 and/or bases 13 requires substantial time, which results in considerable downtime for the machine.

US Patent Application Publication No. 2009/0174252 discloses a two-piece tip having a machined mounting shaft for receipt into the machined bore in the base, and a wear cap that fits over a seat formed on the front end of the shaft. The wear cap bears the brunt of the crushing operation and protects the underlying seat and mounting shaft. Accordingly, only the wear cap usually needs to be replaced. This is an easy and quick process, and results in considerably less throw-away material as the mounting shaft can be reused. Nevertheless, this system still requires machining of the tip's mounting shaft and the base's bore, and difficulty in removing the mounting shaft from the base on account of fines in the bore. The assembly also still suffers from frequent replacement of the bases, which is a lengthy process and results in considerable throw-away material.

SUMMARY OF THE INVENTION

The present invention pertains to an improved wear assembly for use on a driven roll for earth-working machines and the like operations that eases replacement of the wear parts, lengthens the life of the bases, reduces the amount of throw-away material to be discarded, and has a lower manufacturing cost.

In accordance with one aspect of the invention, the tip overlies and protects the base instead of a conventional mounting shaft that is received into a machined bore in the base. This construction lengthens the life of the base and results in less machine downtime and less throw-away material. The use of an overlying adapter eases and speeds replacement of the wear parts to further limit downtime of the machine. The use of such an adapter also eliminates machining of a mounting shaft and receiving bore, such as in the conventional tip and base, which results in lower manufacturing costs.

In accordance with another aspect of the invention, the tip is preferably a two-piece component with no machined parts for lower cost, easy replacement and reduced throw-away material. The tip comprises an adapter that fits over and is releasably secured to a base secured to the roll, and a wear cap that is releasably secured to the adapter. The two components can be cast without subsequent machining for a speedier, less costly manufacturing process. A two-piece tip also leads to less throw-away material as, at times, only the small wear cap needs replacing.

In accordance with another aspect of the present invention, a wear assembly for a driven roll (such as in a double roll crusher) includes a base for attachment to a roll, an adapter that overlies and protects the base, and a wear cap that overlies the front end of the adapter. This wear assembly provides improvements over conventional assemblies. It eliminates the previously required machining of the shafts and bores. The overlying adapter shields the base for a longer useful life. The use of the adapter and a wear cap reduces downtime as these parts are easily removed even with impacted fines. Downtime is also reduced by not having to replace bases as frequently. Such a system results in reduced throw-away material.

In another aspect of the invention, the adapters are fit together with the bases to remain within the dimensional restraints of existing machines so that machines in the field can be readily retrofitted with a base and adapter having the advantages of the present invention without requiring alterations to the machine.

DETAILED DESCRIPTION OF THE PREFERRED EMBODIMENTS

The present invention pertains to a wear assembly (and its components) for use on a driven roll for mining, construction and public works machines such as crushers, surface miners, underground mining machines, milling machines, feeders for recycling machines, and the like, that eases replacement, lengthens the life of the bases, reduces the amount of throw-away material to be discarded, and decreases machine downtime.

Figure 1:
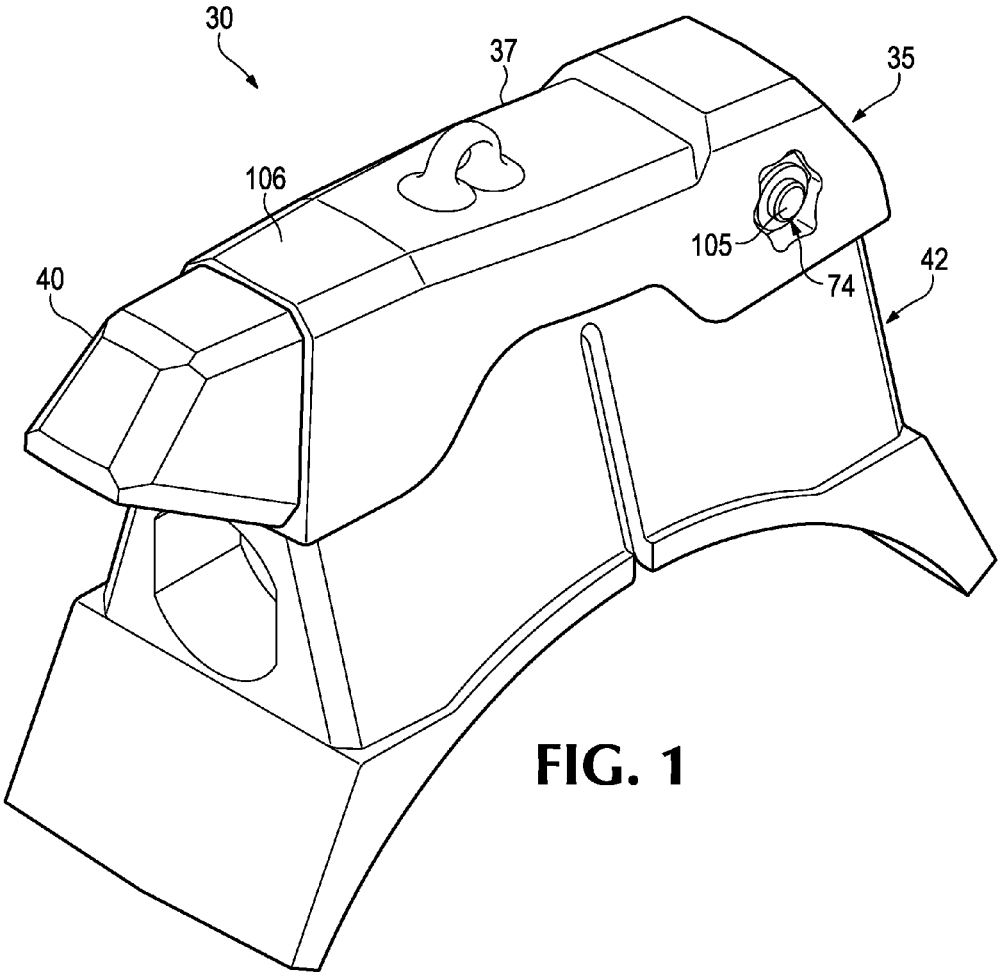
FIG. 1 is a perspective view of wear assembly in accordance with the present invention.
Figure 2:
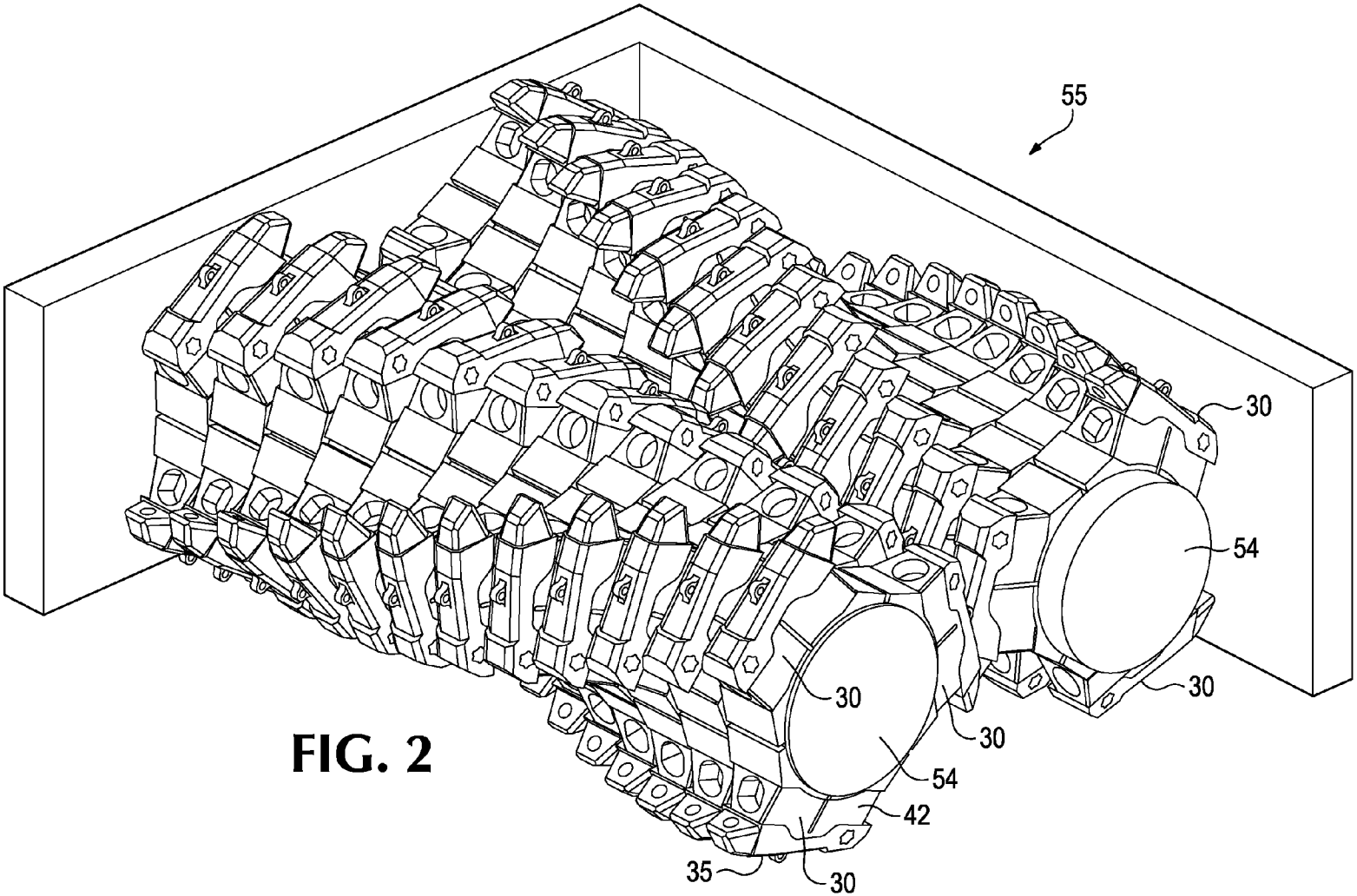
FIG. 2 is a partial, perspective view of a double roll crusher with wear assemblies in accordance with the present invention.
Figure 3:
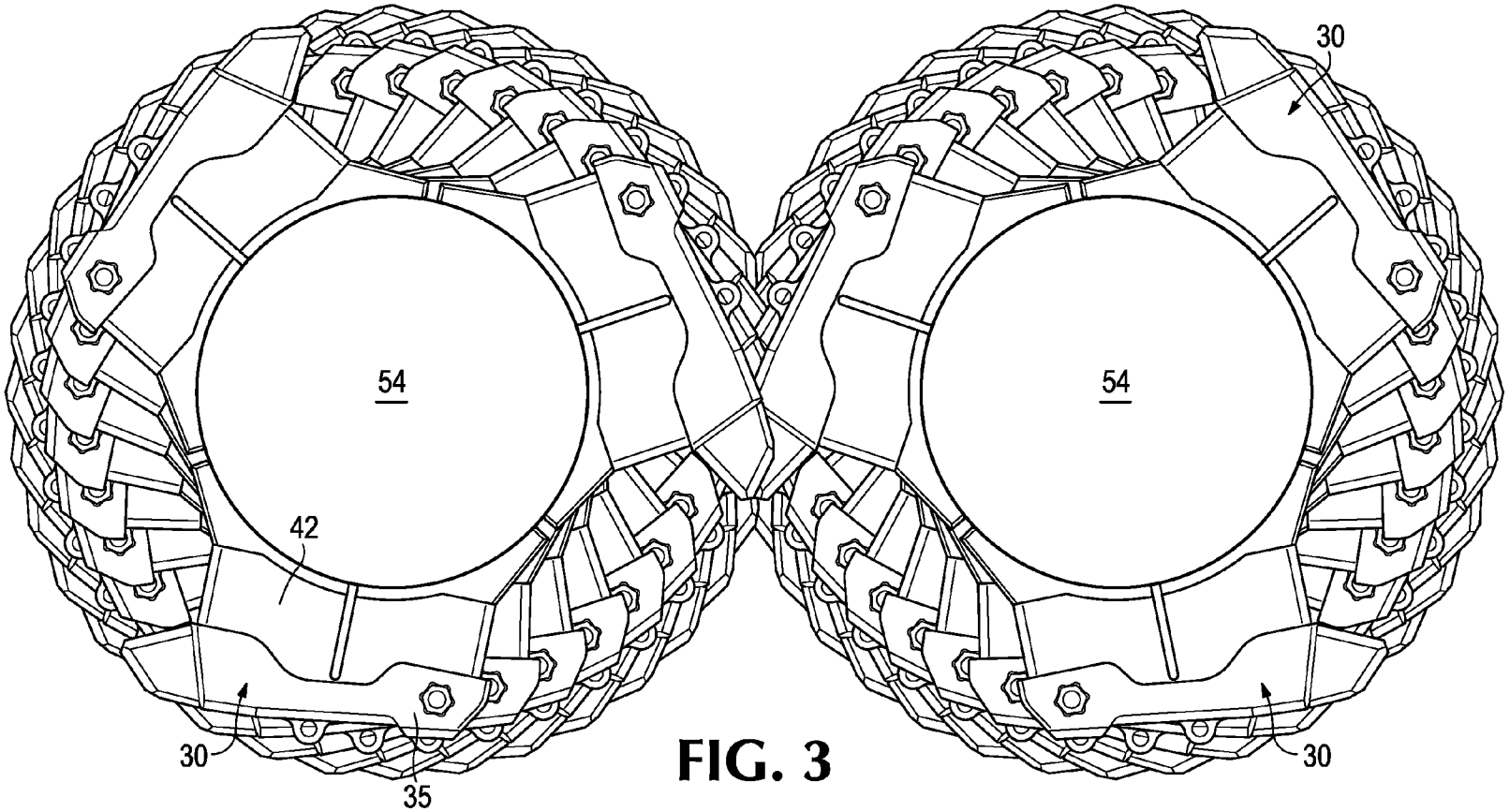
FIG. 3 is a partial, end view of the crusher.

The inventive wear assembly is at times described in this application in relative terms such as upper and lower, front and rear, vertical and horizontal, and the like. These relative terms are not essential to the invention. The orientation of the tip on an earth-working roll constantly changes during operation. Accordingly, the use of these relative terms is not meant to limit the invention, but rather to ease the description. The terms front to rear is intended to be relative to the direction of rotation of the roll such that front or forward are intended to refer to those leading portions in the direction of travel. Upper and lower are intended to refer to the radial orientation with upper or top referring to those portions farther from the rotation axis of the roll. In general, the relative terms are generally to be understood as the wear assembly is illustrated in FIG. 1.

The present invention includes a base 42 for attachment to the driven roll and a replaceable wear part 35 secured to the base. The wear part 35 includes a contact portion 40 that is intended to contact the earthen material when the roll is driven and a mounting portion 37 to secure wear part 35 to base 42. The mounting portion 37 overlies the top of the base 42 to shield and protect base 42 from premature wear during use. The wear part can be a one-piece member, but is preferably composed of two pieces secured together by a retainer. As described below, wear part 35 in one example includes an adapter 37 and a wear cap 40.

The invention in this application is described more fully in the context of a double roll crusher (also known as double roll sizers). Nevertheless, the invention is not limited to this kind of machine. Wear parts in accordance with the present invention are also suitable for use in conjunction with other earth-working machines involving the use of driven rolls such as single roll crushers, scroll crushers, surface miners, underground mining machines, milling machines, feeders for recycling machines, and the like.

A wear assembly 30 in accordance with a preferred embodiment of the invention, as shown in FIGS. 1-29, is for use in a double roll crusher 55. Wear assembly 30 preferably comprises a plurality of cooperating wear parts 37, 40, 42 adapted to improve wear life, reduce downtime, minimize throw-away material for a better and more efficient operation, and lower manufacturing costs. In one preferred embodiment, wear assembly 30 includes a multi-piece tip 35 and a base 42 (also called a holder, sizer cap, ring cap or scroll cap). The tip includes an adapter 37, a wear cap or cone 40, and a retainer or lock 46 releasably securing the wear cap to the adapter. Tip 35 mounts to a base 42, which in turn, is secured to a roll 54 of the crusher 55. These wear assemblies 30 are mounted to the roll in a conventional pattern to crush the received material. Operation of the crusher subjects these wear parts to considerable abuse.

In the present embodiment, the mounting portion 43 of base 42 has a conventional design to attach to rolls in certain existing crusher machines. However, the mounting portion could have other constructions to facilitate use of the wear assemblies 30 in other machines. In this construction, base 42 is a one-piece component that includes a lower skirt 48, a body 50, and a passage 52 for receiving a bolt to secure the base to the roll (FIGS. 4-7). Although base 42 is preferably a one-piece component, it could be composed of multiple components secured together. Lower skirt 48 is spaced slightly from roll 54 and acts to protect the roll from wear. Body 50 is upstanding on skirt 48 and includes a passage 52 through which a bolt (not shown) is passed to secure base 42 to roll 54. A vertical slot 53 extends through skirt 48 and into body 50 to facilitate the desired tightening of base 42 on roll 54. As noted above, this is a conventional mounting arrangement.

A support or supporting portion 44 is formed along the outer end 45 of base 42 to mount and support adapter 37. Adapter 37 preferably overlies the entire outer end 45 of base 42 to shield the base from premature wear, but a shielding benefit is still achieved (though to a lesser extent) if the adapter were to overlie only a portion of base 42. Use of an adapter overlying the base can in some circumstances increase the useful life of the base up to two times or more as compared to a conventional base that receives a shaft in a mounting bore. Instead of the more frequent, time-consuming replacement of the bases, operators typically only need to replace wear caps 40 and adapters 37—with wear caps 40 being replaced most frequently. These wear parts are easy to replace, require less machine downtime, and reduce the throw-away material.

Supporting portion 44 preferably includes a central rail 56 and a stepped surface 58 along each side of rail 56 for increased rigidity of base 42 and to permit thicker sidewalls 60 of adapter 37 without increasing the overall thickness of wear assembly 30 beyond acceptable clearances within existing machines (FIGS. 4-7). Thicker sidewalls 60 increase adapter strength and rigidity, and provide longer life to the adapter. A plurality of bearing surfaces 62 are preferably provided along the front surface 64 and outer surface 66 of rail 56. Bearing surfaces 62 are intended to primarily resist the heavy forces applied to adapter 37 in use. Although the entire front and outer surfaces 64, 66 could form primary bearing surfaces for adapter 37, it is easier to control the flatness and tolerance range of a smaller, discrete surface along rail 56 to form a better bearing surface, particularly since these components are preferably manufactured of hardened steel in a sand casting process. In this example, a front bearing surface 62*a* is provided on front surface 64 and a pair of outer bearing surfaces 62*b* is provided on upper surface 66. Nevertheless, other arrangements are possible including, for example, the use of bearing surfaces along stepped surfaces 58.

Figure 4:
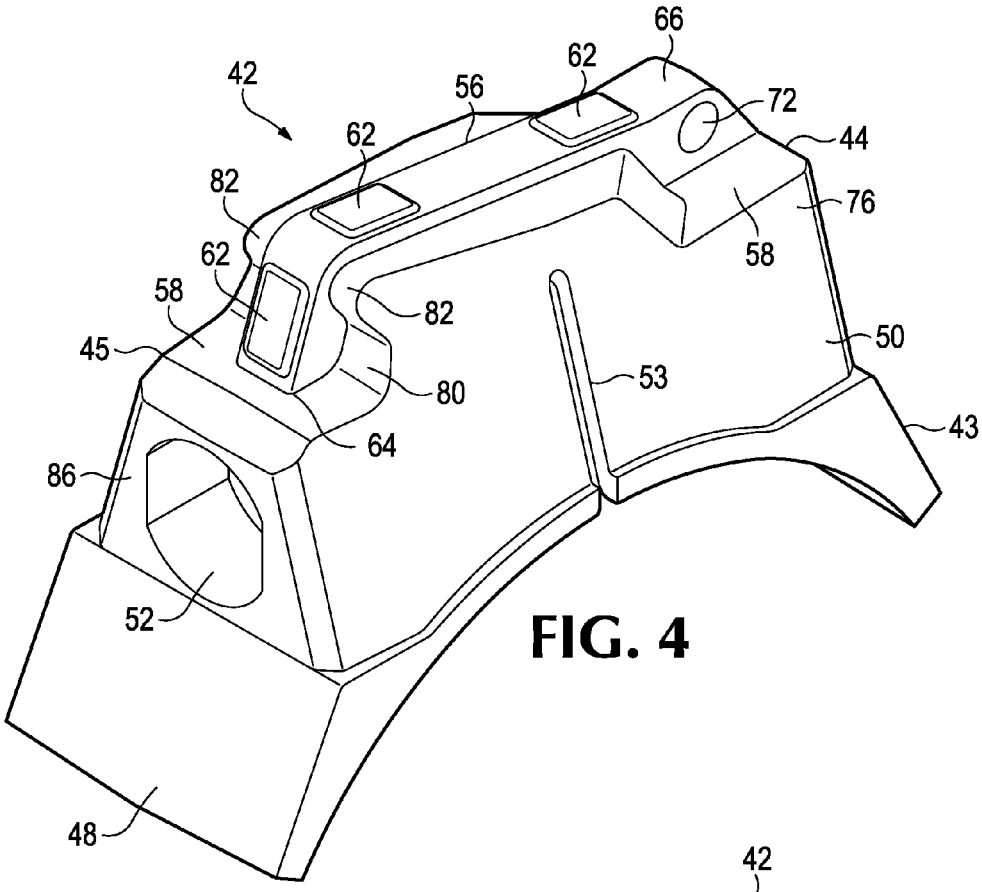
FIG. 4 is a perspective view of a base of the wear assembly.
Figure 5:
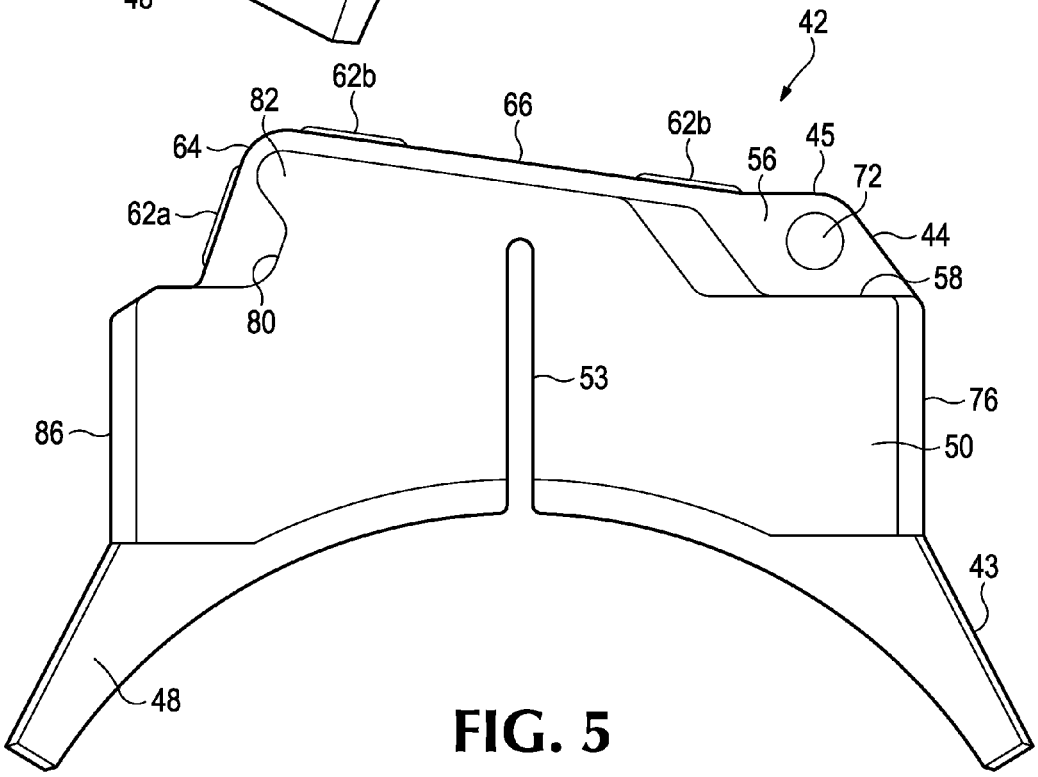
FIG. 5 is a side view of the base.

In this embodiment, supporting portion 44 includes a hole 72 for receiving a lock or fastener 74 to attach adapter 37 to base 42 (FIGS. 4 and 5). Hole 72 extends transversely through rail 56 though other positions and orientations are possible. Stepped surfaces 58 are stepped lower along the rear portion 76 of base 42 to permit ample space for the formation of hole 72. Fastener 74 is preferably a nut and bolt arrangement but other fasteners could be used.

Figure 6:
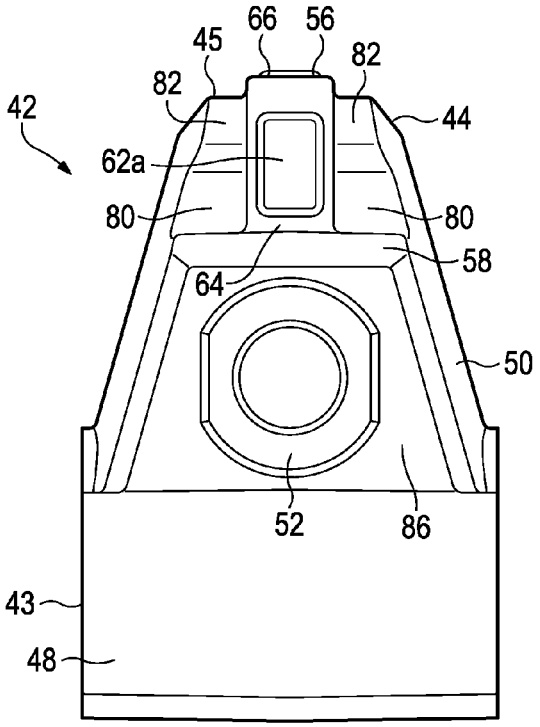
FIG. 6 is a front end view of the base.
Figure 7:
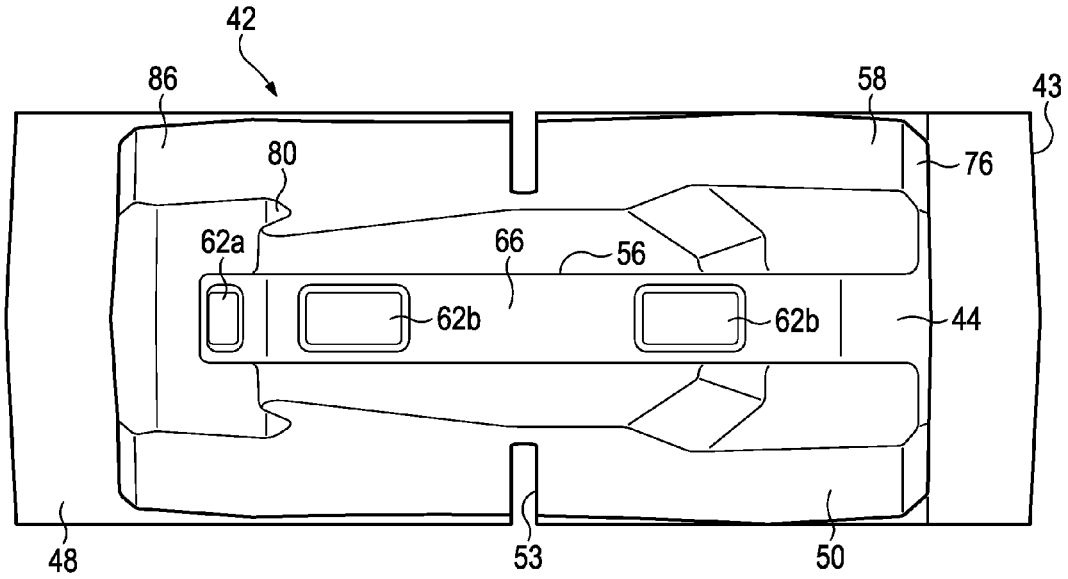
FIG. 7 is a top view of the base.
Figure 8:
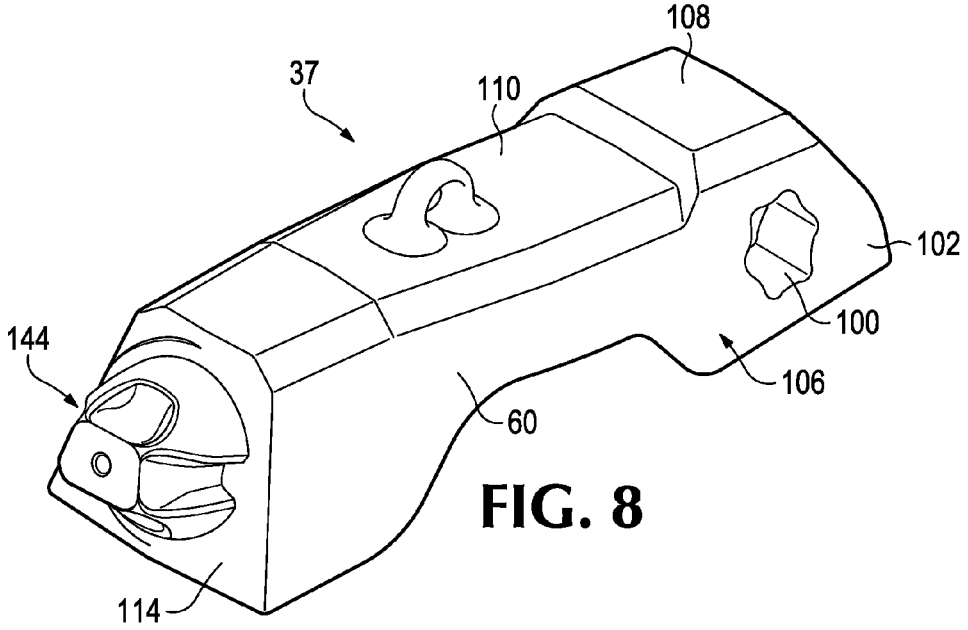
FIG. 8 is a perspective view of an adapter of the wear assembly.
Figure 9:
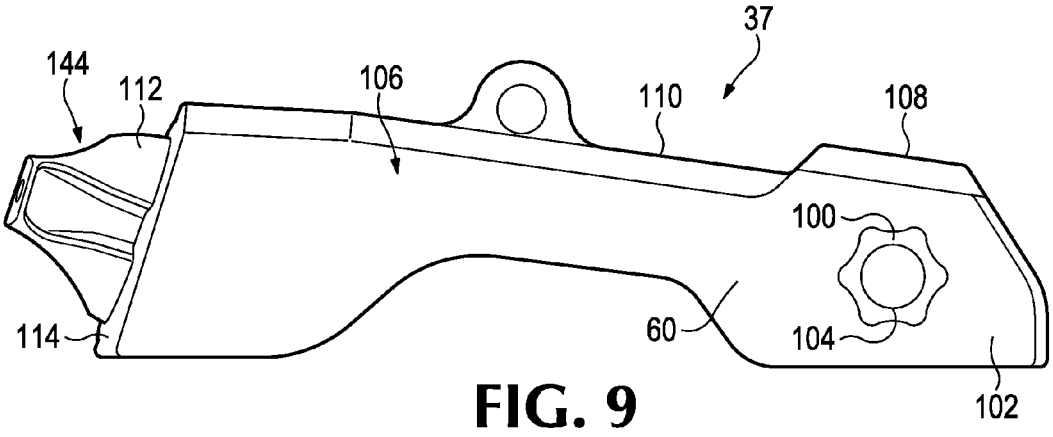
FIG. 9 is a side view of the adapter.
Figure 10:
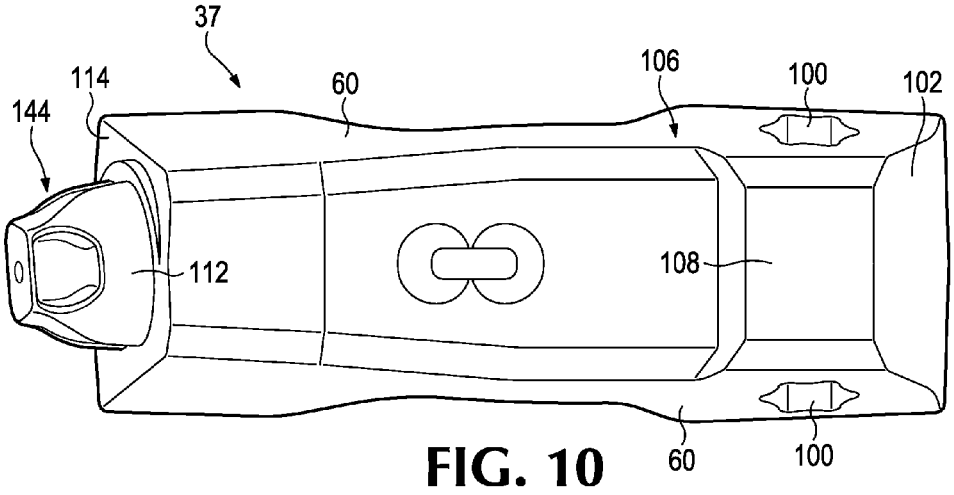
FIG. 10 is a top view of the adapter.
Figure 11:
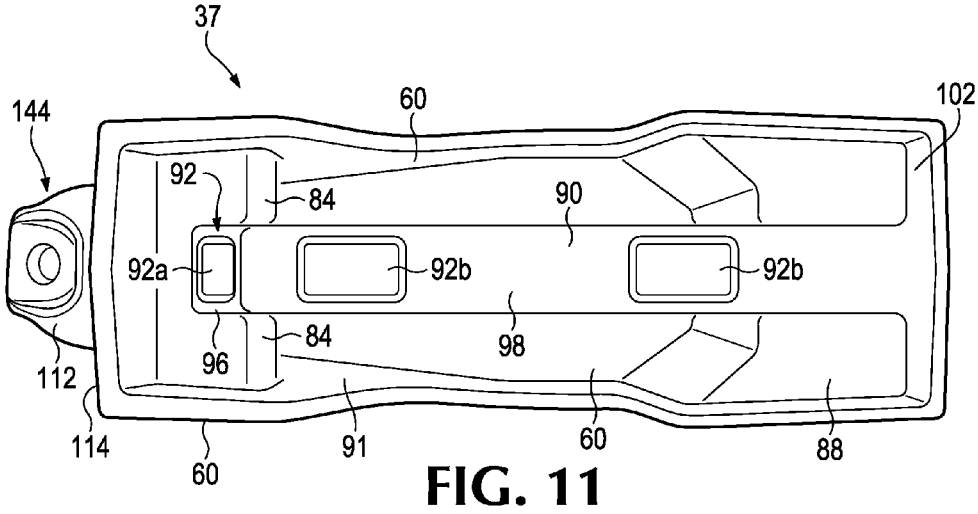
FIG. 11 is a bottom view of the adapter.
Figure 12:
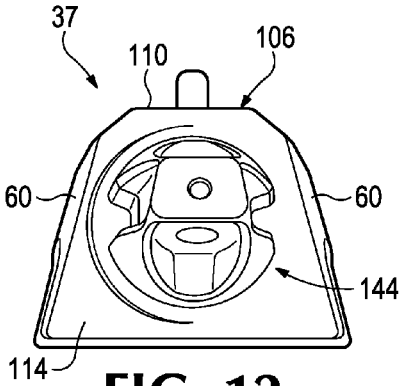
FIG. 12 is a front end view of the adapter.
Figure 13:
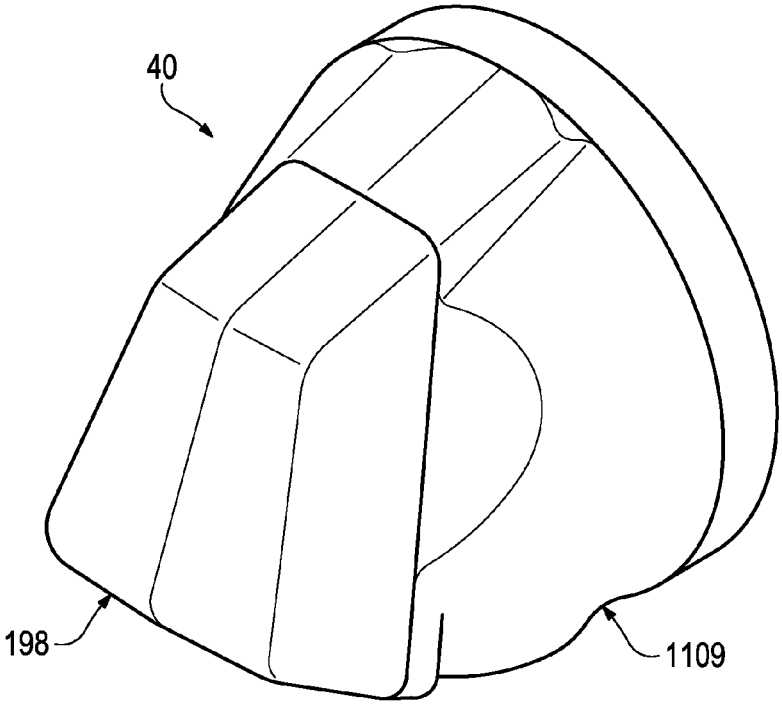
FIGS. 13 and 14 are perspective views of a wear cap of the wear assembly.
Figure 14:
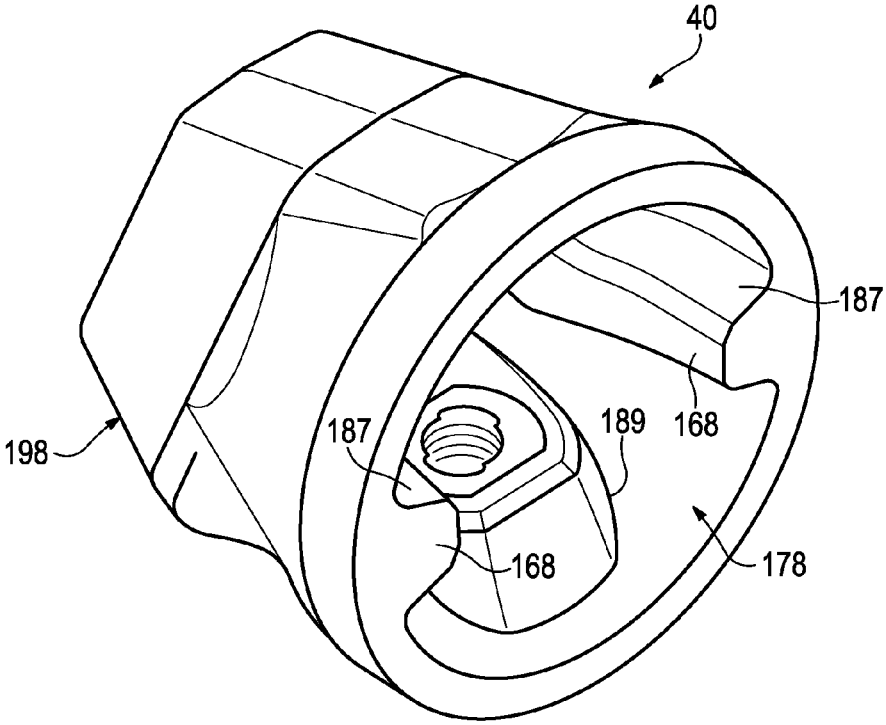
Figure 15:
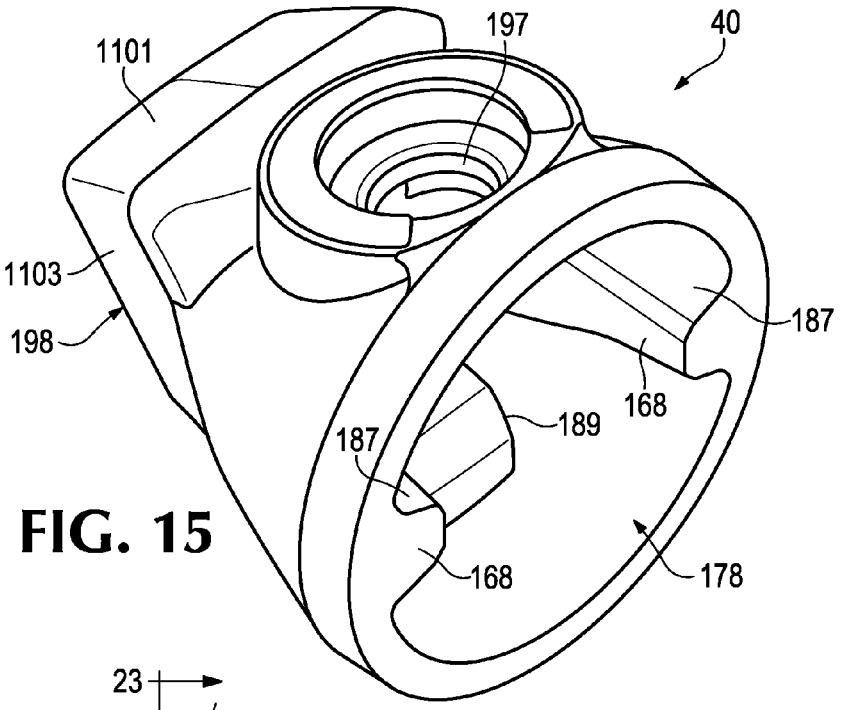
FIG. 15 is an inverted, perspective view of the wear cap.

Supporting portion 44 preferably includes one or more recesses 80 defined in part by overhanging supports or ledges 82 (FIGS. 4, 5 and 6). Recesses 80 are adapted to receive complementary hooks or fingers 84 of adapter 37 that engage supports 82 to resist loads applied to the adapter during use of the crusher, and retain adapter 37 to base 42. Two symmetrical recesses 80 (one on each side of rail 56) are provided in the illustrated example, though one recess or more than two recesses in other arrangements could be used. Supports 82 for hooks 84 could be provided without the corresponding recesses 80. Further, other means could also be used to hold adapter 37 to base 42 including other interlocking constructions and/or the use of a fastener in the front portion 86 of base 42. Impact of the wear caps 40 against rock or other material received into crusher 55 on account of rotation of the wear assemblies 30 imposes high impact loads which tend to apply rearward and outward forces against tip 35. Supports 82 provide suitable resistance to these rearward and outward forces to retain the adapter in place. The receipt of hooks 84 into recesses 80 is intuitive, easy, and quick for the worker during installation and removal.

Adapter 37 defines the base for tip 35 (FIGS. 8-12). In this embodiment, adapter 37 includes a cavity 88 (FIG. 11) adapted to complement supporting portion 44 of base 42. Accordingly, cavity 88 includes a first portion 90 to receive rail 56, and a second portion 91 to be received over the remainder of the supporting end 44 of base 42. As a result, cavity 88 is preferably stepped such that sidewalls 60 overlie supporting portion 44 to an extent below stepped surfaces 58. Complementary bearing surfaces 92 are provided along a front surface 96 and inner surface 98 of cavity 88 such that front bearing surface 92*a* in cavity 88 contacts front bearing surface 62*a* on rail 56, and inner bearing surfaces 92*b* contact outer bearing surfaces 62*b*. While other surfaces of adapter 37 will bear against other portions of base 42 during use, bearing surfaces 62, 92 are intended to be primary bearing surfaces between adapter 37 and base 42.

A hole 100 passes through a rear portion 102 of adapter 37 (FIGS. 8-10) to align with hole 72 in base 42 to define a passage for receiving fastener 74, which is preferably a bolt and nut. A countersink 104 (FIG. 9) is formed at each end of hole 72 to receive the bolt head on one end and the nut on the other. The countersinks are preferably both hexagonal in order to permit receipt of the fastener in either direction. In this embodiment, the nut mates with the countersink so as to prevent its rotation, while the head is rounded for rotation within the countersink; i.e., the head includes a socket 105 to receive a tool. Nevertheless, other arrangements are possible.

The exterior of adapter 37 defines a wear surface 106 (FIGS. 1, 8-10 and 12) adapted to protect supporting portion 44 and shield base 42 to lengthen the lifespan of the base. A breaker face 108 is preferably formed along an outer surface 110 of the rear portion 102 of adapter 37 to lengthen the useful life of the adapter 37. Breaker face 108 is a bulked up or thickened portion of steel formed at the rear end where rock and other material to be crushed often strike as the wear assembly is rotated.

Adapter 37, i.e., the base of tip 35, preferably includes a nose 112 along front surface 114 defining a seat 144 for wear cap 40 (FIGS. 8-12). The wear cap sets over the seat to engage the material to be worked, e.g., the mined material fed into crusher 55. Wear cap 40 is a wear part that is releasably secured to adapter 37 by a retainer 46. The seat 144 and wear cap 40 preferably have the same construction as the described in US Patent Application Publication No. 2009/0174252, which is incorporated herein by reference. Nevertheless, other constructions could be used. Further, tip 35 could be a one-piece member, i.e., where wear cap 40 and adapter 37 are formed as a one-piece component. While not preferred, such one-piece tips would still shield the bases and eliminate the need for machined parts.

Figure 22:
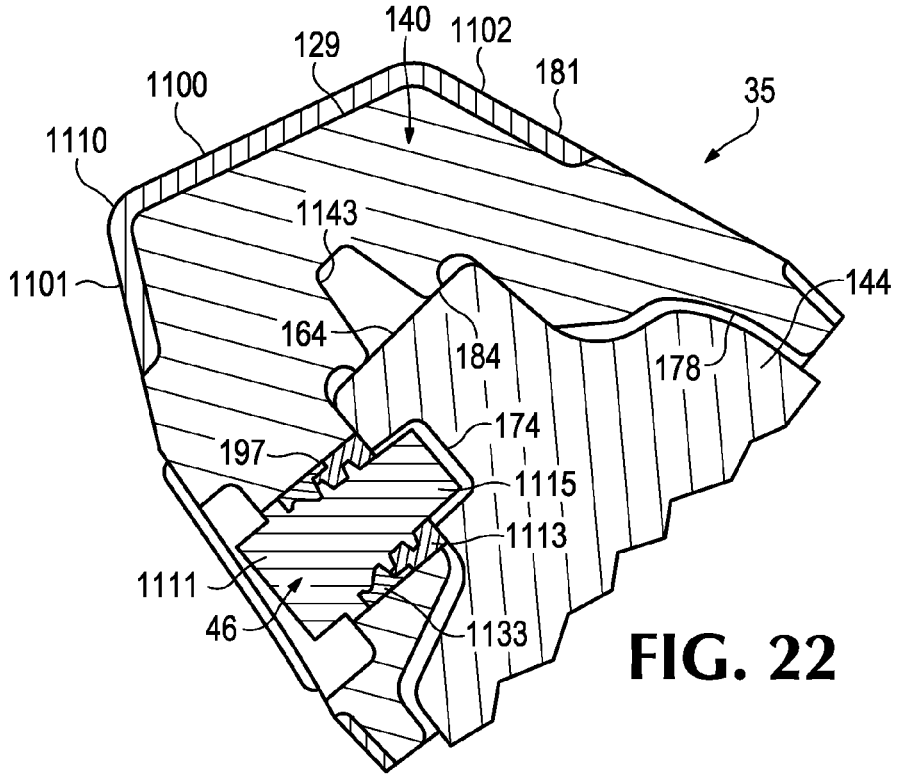
FIG. 22 is a longitudinal cross sectional view of the wear cap mounted on a seat of the adapter.
Figure 25:
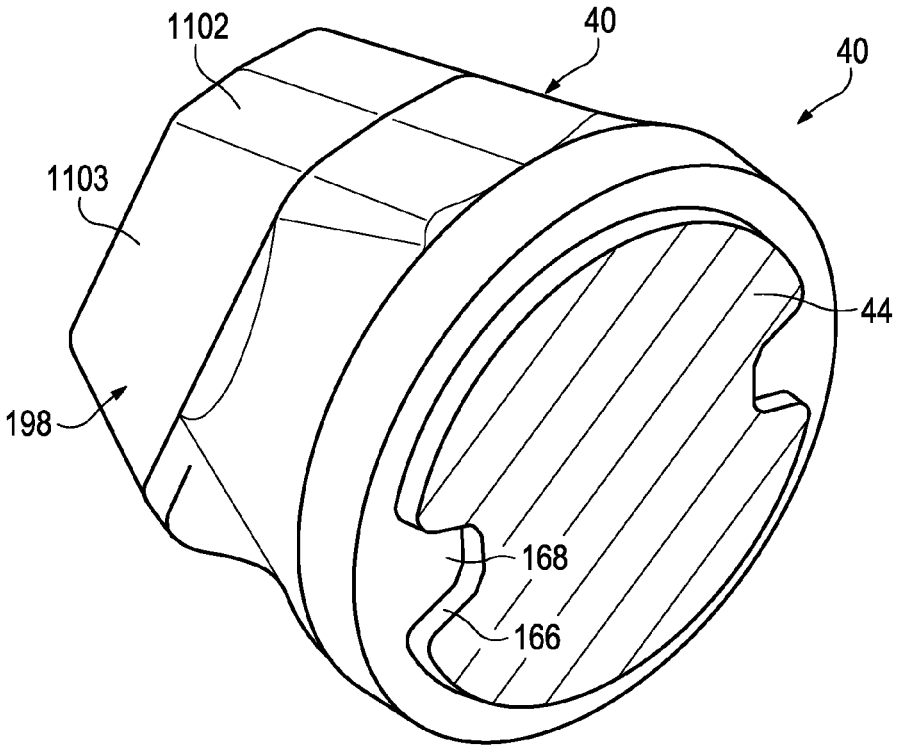
FIG. 25 is a perspective view of the transverse sectional view of FIG. 22.
Figure 26:
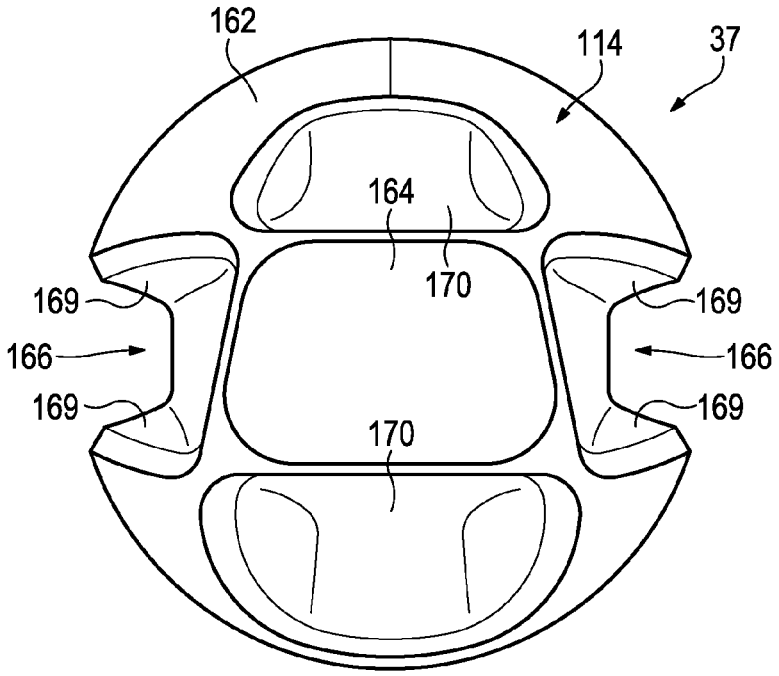
FIG. 26 is an enlarged front end view of the seat of the adapter.
Figure 27:
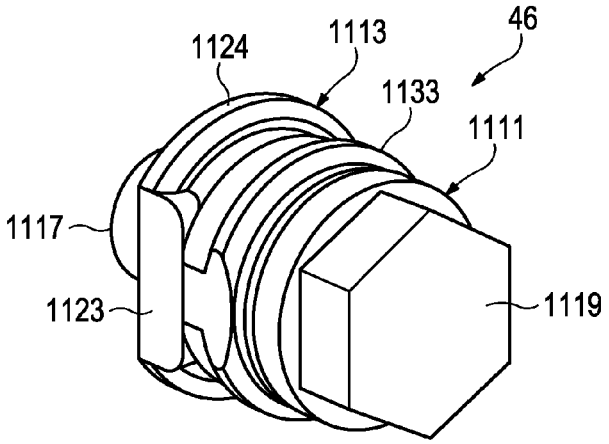
FIG. 27 is a perspective view of a retainer for the tip.
Figure 28:
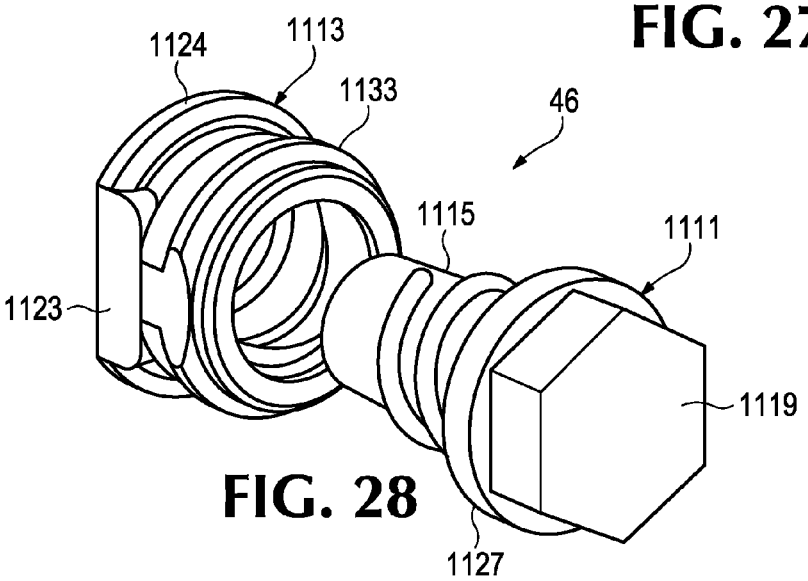
FIG. 28 is an exploded perspective view of the retainer.
Figure 29:
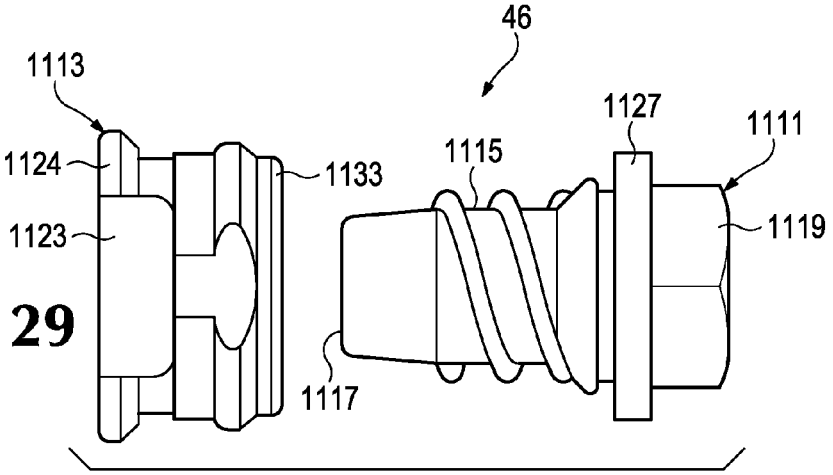
FIG. 29 is an exploded side view of the retainer.
Figure 30:
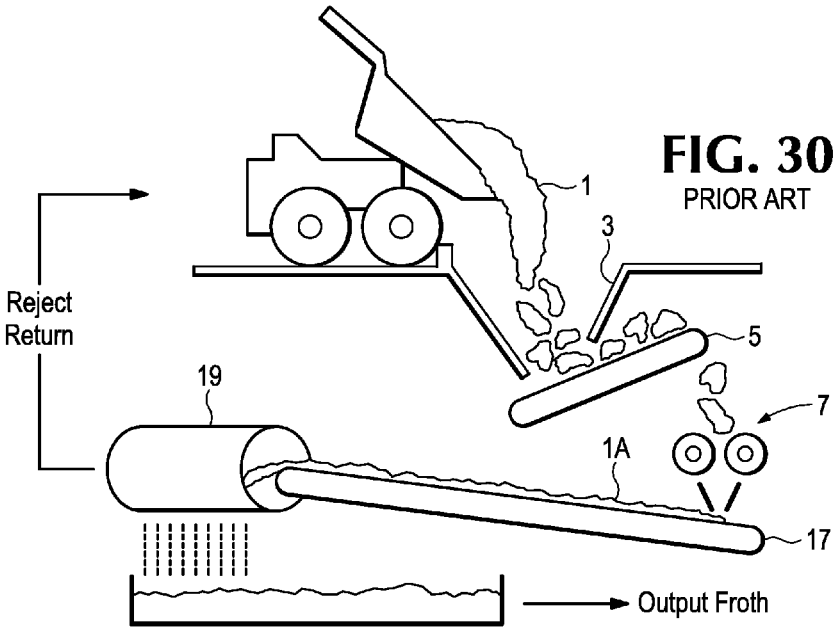
FIG. 30 PRIOR ART
FIG. 30 is a schematic illustration of a mining operation with a double roll crusher.
Figure 31:
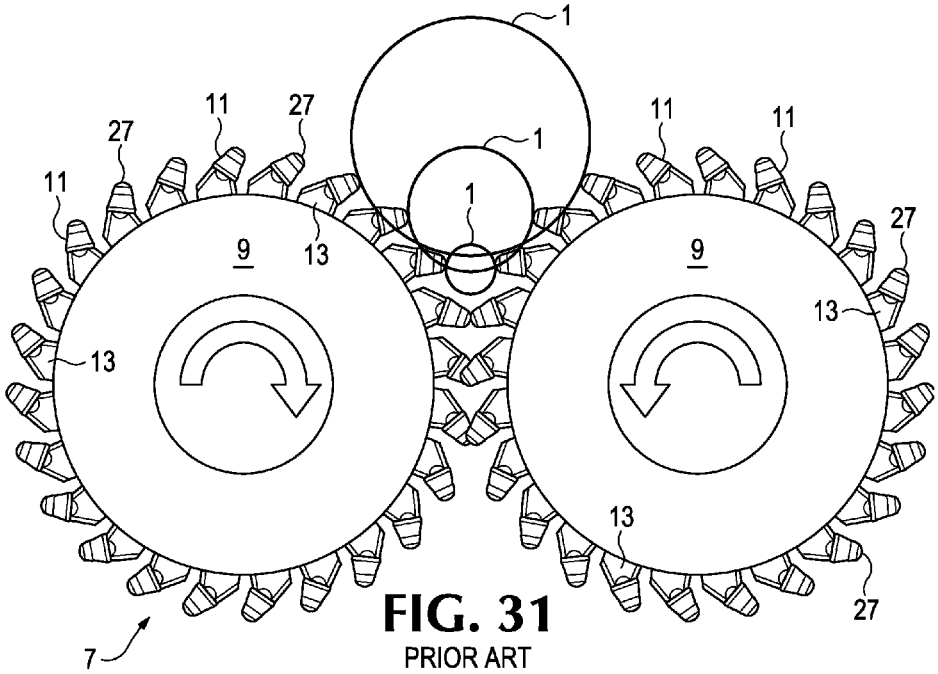
FIG. 31 PRIOR ART
FIG. 31 is a schematic illustration of the operation of the rolls in a double roll crusher.
Figure 32:
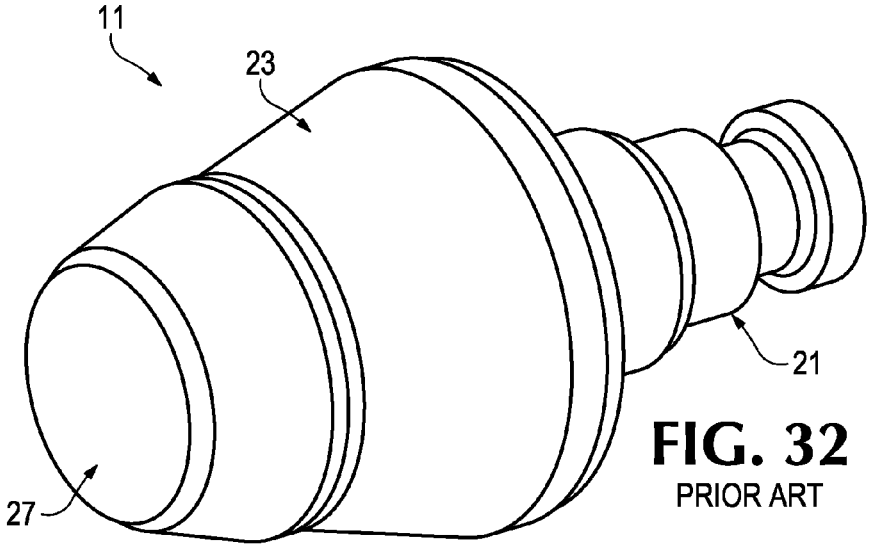
FIG. 32 PRIOR ART
FIG. 32 is a perspective view of a conventional tip.
Figure 33:
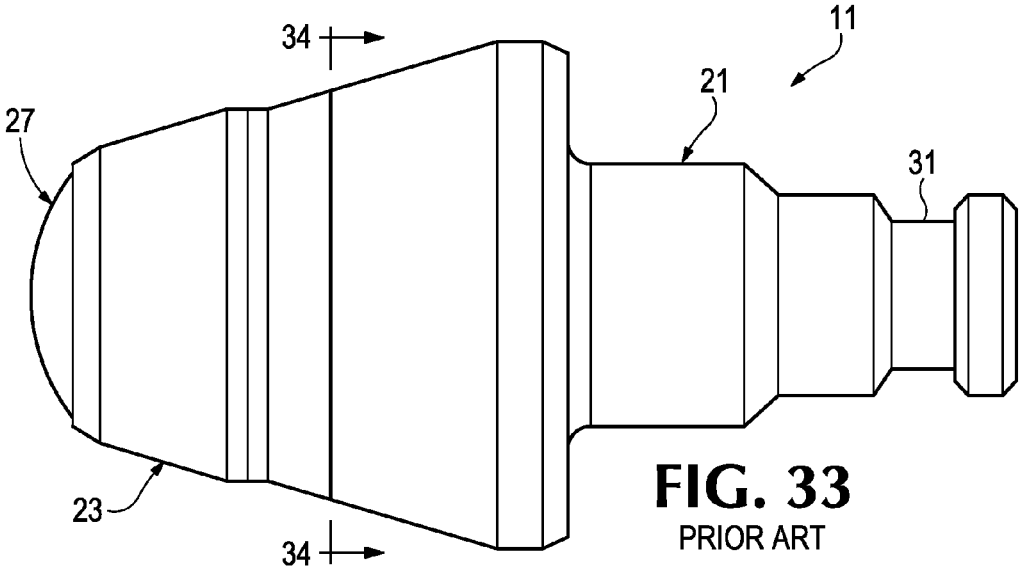
FIG. 33 PRIOR ART
FIG. 33 is a side view of the conventional tip.
Figure 34:
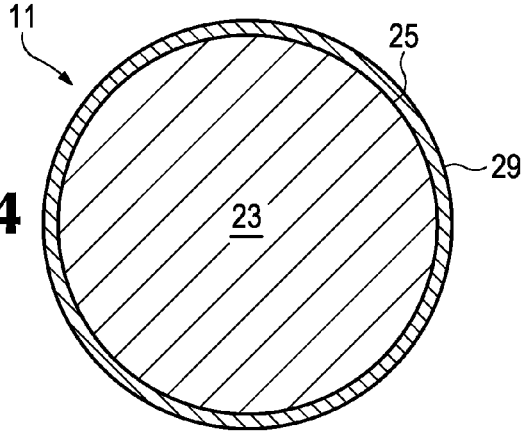
FIG. 34 PRIOR ART
FIG. 34 is a cross sectional view of the conventional tip taken along line 34-34 in FIG. 33.

Seat 144 of adapter 37 supports wear cap 40 (FIGS. 22 and 25). Seat 144 preferably has a generally rounded exterior surface 162 that tapers toward front face 164 (FIGS. 10-12 and 22 and 26). Front face 164 is preferably flat and generally perpendicular to axis 160 of nose 112, but could have other shapes or orientations. Grooves 166 are preferably provided on opposite sides to receive rails 168 of wear cap 40 to prevent rotation of the wear cap about axis 160. Grooves 166 preferably extend entirely across seat 144 in the axial direction to maximize the retention force, but could have only a partial extension if desired. The marginal edges 169 of each groove 166, in a transverse direction, are preferably inclined outward for easier manufacture and receipt of rails 168. Nevertheless, marginal edges 169 could also be horizontal. The grooves could be placed in different locations, though on opposite sides is preferred to provide maximum resistance to loads applied perpendicular to the longitudinal axis. The grooves could be curved or have other shapes. There could also be only one groove or more than two grooves. Finally, other structural arrangements could be used to prevent rotation of the wear cap and/or provide resistance to transverse loading of the tip.

Seat 144 preferably includes stabilizing surfaces 170 to provide stable support for wear cap 40. Stabilizing surfaces 170 are vertically aligned and extending rearward from front face 164. Stabilizing surfaces 170 are substantially parallel to axis 160. The term "substantially parallel" includes surfaces that are parallel to axis 160 as well as those that are at a small angle $\alpha$ to axis 160, e.g., of about 1-7 degrees. The stabilizing surface preferably diverges axially rearward at a small angle to axis 160 for ease of manufacturing. Stabilizing surfaces 170 preferably each extend axially at an angle to axis 160 of 5 degrees or less, and most preferably 2-3 degrees. The stabilizing surface 170 provides enhanced support for the wear cap 40 against impact and other applied forces during use. A hole 174 is preferably formed in the lower stabilizing surface 170 for receipt of retainer 46, but other arrangements and other positions could be provided to cooperate with retainer 46.

Wear cap 40 includes a cavity 178 that opens or faces rearward to receive seat 144, and a wear surface 181 that faces generally forward for engaging material (FIGS. 13-22). Cavity 178 corresponds to the configuration of seat 144. In the illustrated embodiment, cavity 178 is generally closed around its perimeter, but in other embodiments, the cavity may be open along one or more of its sides. The seat and cavity could have a wide variety of constructions so long as they provide sufficient support for the wear cap. The entire seat is preferably received into wear cap 40 to protect it from the earthen material and premature wear. Alternatively, the base could define the cavity and the wear cap the protruding seat.

In this embodiment, cavity 178 has a generally rounded configuration, particularly in the rear portion, to matingly receive the rounded exterior surface 162 of seat 144, and a front surface 184 that bears against front face 164. A pair of inwardly projecting rails 168 extends axially along opposite sides of cavity 178 for receipt within grooves 166. The sidewalls 187 of each rail 168 are shaped to match the shape of marginal edges 169. The receipt of rails 168 in grooves 166 resists rotation of wear cap 40 about axis 160 during use. Rails 168 also provide vertical support against loads applied to the wear cap. Alternatively, rails could be provided on the seat and grooves on the cavity in the wear cap. Other arrangements for preventing rotation of the wear cap could also be used in lieu of or in addition to the rails and grooves.

Cavity 178 further includes upper and lower supports 189 with stabilizing surfaces 195 that fit within recesses 196 of seat 144 so that stabilizing surfaces 195 contact and bear against the complementary stabilizing surfaces 170. Stabilizing surfaces 195, like stabilizing surfaces 170, axially extend substantially parallel to the longitudinal axis 160. While stabilizing surfaces 170, 195 are preferably flat, they could be curved or have other configurations. Moreover, as an alternative, stabilizing surfaces 170, 195 could have a greater inclination to axis 160 in the axial direction and not be substantially parallel to axis 160 for certain applications, for example, those in lighter duty applications. Also, in certain applications, the wear cap and seat could each include only one stabilizing surface in engagement with each other to resist loading in one primary direction. Further, arrangements other than such stabilizing surfaces could be used to support the mounting of the wear cap on the base. An opening 197 is provided through the lower support 189 to align with hole 174 in adapter 37 when the wear cap is mounted on the seat for receipt of retainer 46.

Wear surface 181 has a front portion 198 that makes initial and primary contact with material and, in crusher 55, is primarily responsible for breaking up the material. The front portion 198 includes a front surface 1100 facing generally forward, a leading surface 1101 facing generally in the direction the tip moves with the roll, a trailing surface 1102 opposite the leading surface, and side surfaces 1103 extending between the leading and trailing surfaces 1101, 1102. The front portion 198 is preferably formed with side relief to reduce wear and drag on the tip so that the usable life of the tip is lengthened and less power is needed to drive the roll. Side relief is provided by forming the side surfaces 1103 to be predominantly within the width or lateral sides 1105 of the leading surface 1101.

In this embodiment, side surfaces 1103 are generally planar and inclined inward from the leading surface 1101, i.e., the side surfaces 1103 generally converge toward each other as they extend to trailing surface 1102. This arrangement provides a front portion 198 for wear cap 40 that has a generally trapezoidal transverse configuration. In this embodiment, portions of the leading surface 1101 are wider than the opposite, corresponding portions of the trailing surface 1102; the corresponding portions of the two surfaces 1101, 1102 being those that are opposite each other in a direction perpendicular to the longitudinal axis 160. This inward inclination enables side surfaces 1103 to be protected by leading surface 1101 and experience reduced pressure from and contact with the earthen material; see the general flow F of the material 1 relative to the front portion 198 in FIG. 16. Reduced pressure and contact translates into reduced wearing of the tips and lessened drag on the rolls being rotated. It has been determined that the primary contact with material 1 and wearing of the tips occurs along the front end of the tips. Side relief, then, is preferably provided only along front portion 198. In this way, rear portion 1109 expands to accommodate an expanded rear portion of seat 144 for strength of the seat and a stable support against base 42. Nevertheless, side relief could extend through most or the entire wear cap. The front end of seat 144 also preferably has a generally trapezoidal shape to better accommodate the exterior side relief in wear cap 40 but other shapes could be used.

Figure 23:
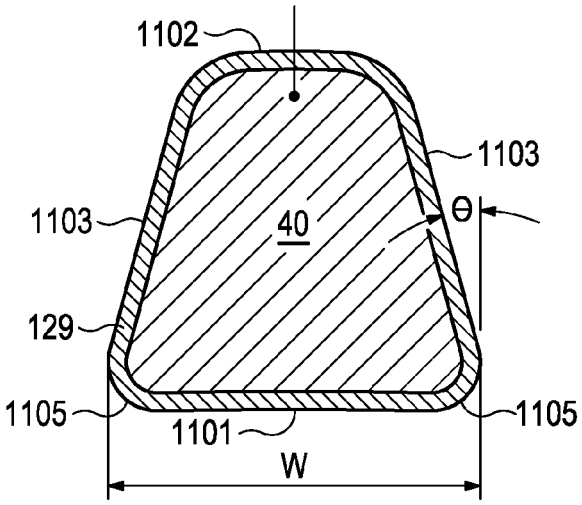
FIG. 23 is a cross sectional view taken along line 23-23 in FIG. 16.
Figure 24:
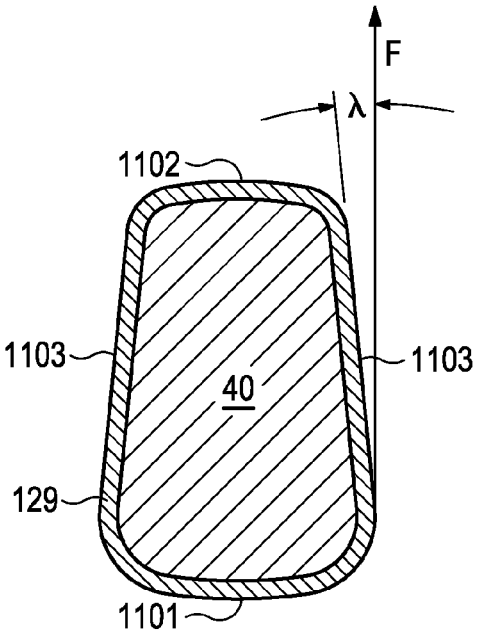
FIG. 24 is a cross sectional view taken along line 24-24 in FIG. 16.

The side surfaces 1103 are each preferably inclined inward at a transverse angle θ so that they are within the width W of leading surface 1101 (FIG. 23). In this way, side surfaces 1103 travel in the shadow of leading surface 1101 passing through material 1 so that they experience less wear and drag. In one preferred construction, the transverse angle θ is sufficiently great so that the side surfaces 1103 of front portion 198 are inclined inward in the penetration profile for the wear cap 40 (FIG. 24). The penetration profile is the cross-sectional configuration of the tip taken in the primary direction of the flow of the earthen material 1 relative to the tip. For example, in a double roll crusher 55, the earthen material tends to flow relative to the tips at an inclination to the longitudinal axis 160 of the tips 35 (FIG. 5). In conventional tips, this relative movement causes wear to develop in cone 23 at this inclination to the longitudinal axis 160, particularly when fines prohibit rotation of the tip. In one exemplary double roll crusher 55, the flow of material 1 relative to the tip is at an angle of about 70 degrees to the longitudinal axis 160. The penetration profile for tips in this machine would then be along a transverse plane at an angle of about 70 degrees relative to axis 160. By providing side relief in the penetration profile, side surfaces 1103 remain inward of the leading surface 1101 with respect to the primary flow of the material relative to the tips. This arrangement provides enhanced protection for the tip and further reductions in the drag on the roll.

In one preferred example, side surfaces 1103 are inclined to define a transverse angle θ of about 15 degrees (FIG. 23) so as to provide about a 5 degree angle λ in the penetration profile (FIG. 24). As can be appreciated, a 15 degree transverse angle θ results in the side surfaces converging toward each other with an included angle of about 30 degrees. Nevertheless, side surfaces 1103 may be inclined at other transverse angles and still provide some benefits of side relief. While inclining each side surface 1103 in the penetration profile at an angle λ of at least 5 degrees is preferred, smaller angles will still result in reduced wear and drag. Also, side surfaces 1103 that are predominately within the width of the leading surface 1101, but which are not inclined inward in the penetration profile will still provide reduced wear and drag as compared to tips with no side relief. Although side relief is preferably only provided in front portion 98, it could be extended into rear portion 1109 as well. Wear cap 40 though could have no side relief.

Front surface 1100 of wear cap 40 is preferably inclined to axis 160 at an angle that is generally parallel to the direction of the relative flow of material 1 to tip 35. Accordingly, front surface 1100 is preferably inclined at an angle ϕ of about 70 degrees to longitudinal axis 160 for a double roll crusher. Nevertheless, other angular orientations could be used. Although a planar front surface 1100 is preferred, the front surface could alternatively have a slight concave or convex curvature. Moreover, the front end could have other shapes including a blunt, rounded front end, a sharp digging point, or other configurations. The front surface may optionally be formed of carbide or another hard material or have hard inserts of carbide, ceramic or other hard material.

Figure 16:
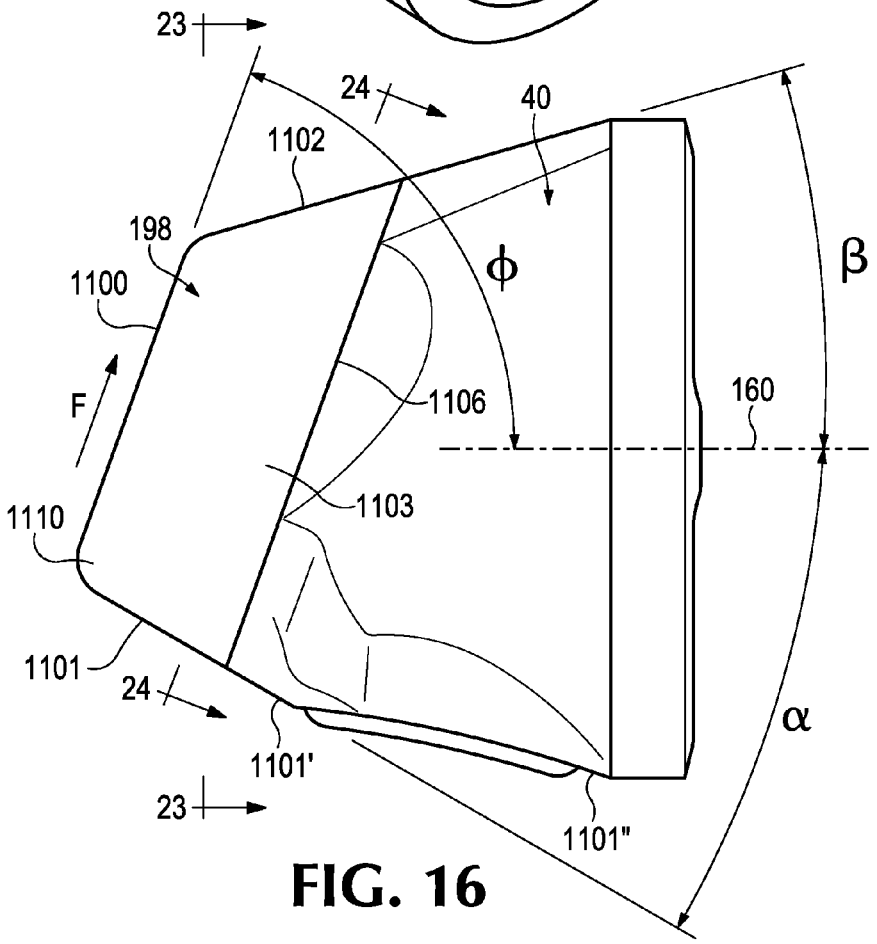
FIG. 16 is a side view of the wear cap.
Figure 17:
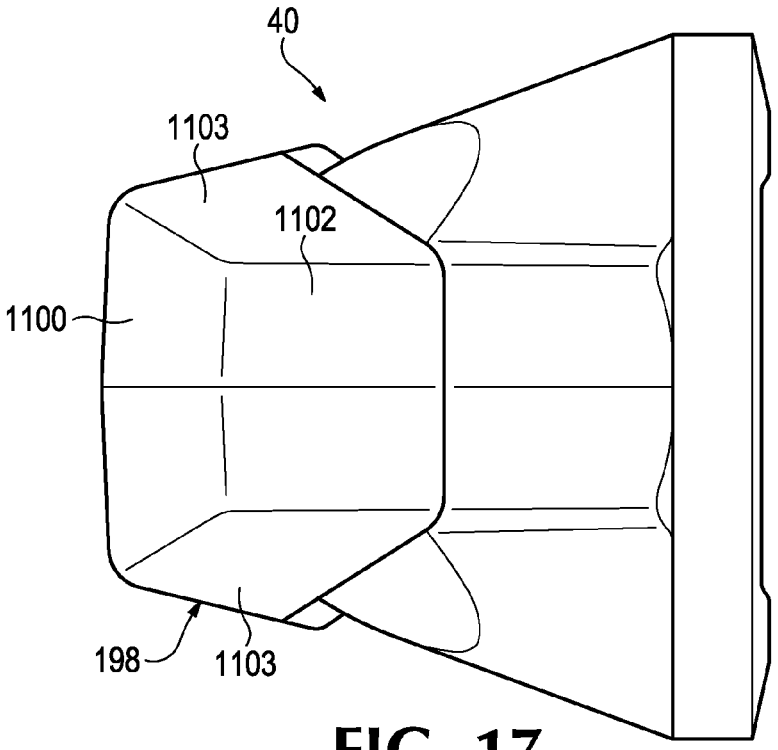
FIG. 17 is a top view of the wear cap.
Figure 18:
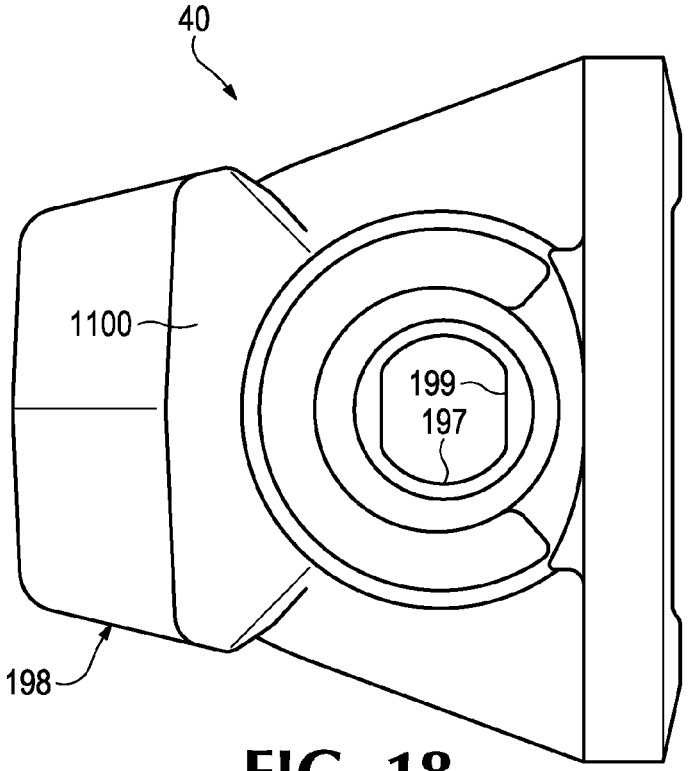
FIG. 18 is a bottom view of the wear cap.
Figure 19:
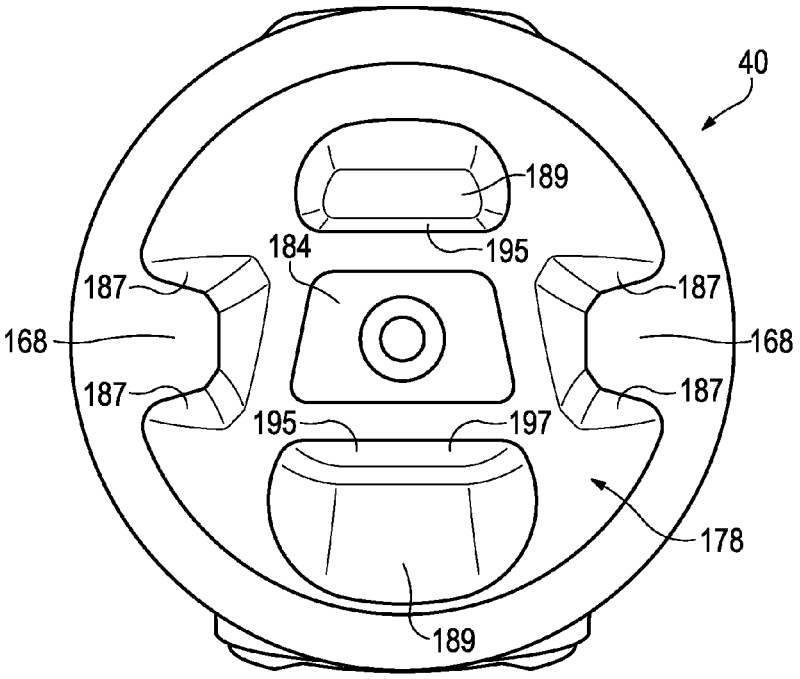
FIG. 19 is a rear view of the wear cap.
Figure 20:
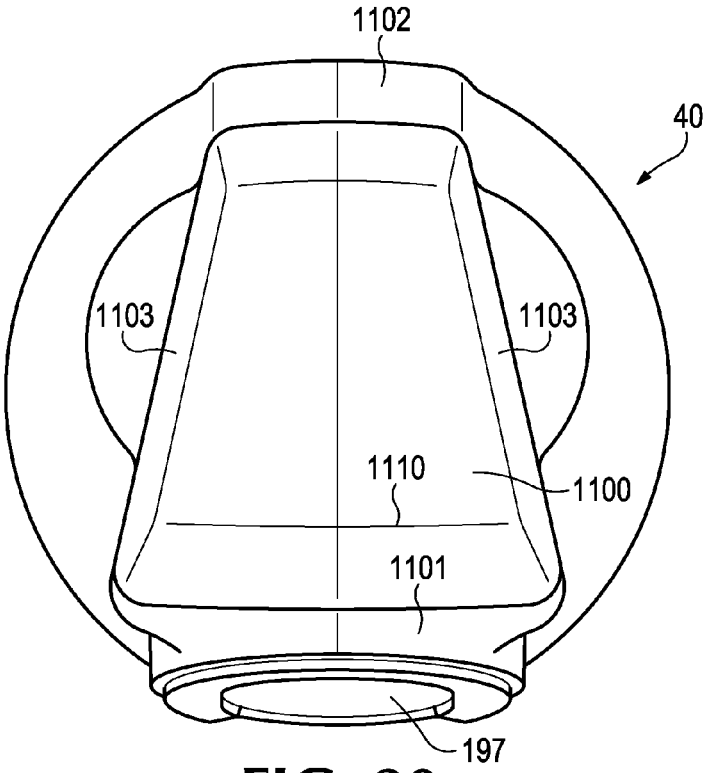
FIG. 20 is a front view of the wear cap.

Leading surface 1101 is preferably inclined forwardly and upwardly relative to axis 160 so that the foremost portion of wear cap 40 is an impact corner 1110 to strike rock and other earthen material needing to be broken up. The formation of a corner to primarily impact rock and the like is a strong construction that is not easily broken. As seen in FIG. 16, leading surface 1101 preferably has a front segment 1101' and rear segment 1101", though it could have a uniform configuration rearward of front surface 1100. In a preferred construction, front segment 1101' extends rearwardly from front surface 1100 at an angle $\alpha$ of about 30 degrees to axis 160 to form impact corner 1110. Rear segment 1101" is preferably inclined at a smaller angle relative to axis 160 to offer some shielding of retainer 46. Trailing surface 1102 preferably extends rearward from front surface 1100 at an angle $\beta$ of about 15 degrees to axis 160. Nevertheless, other orientations are possible.

Wear caps in accordance with the invention can have shapes other than illustrated. The side surfaces can be placed at different angles to the leading surface. The side surfaces need not be planar and can be, e.g., curved, angular or irregular. Side relief benefits can still be obtained even if the side surfaces extend laterally beyond the width of the leading surface so long as the side surfaces are predominantly within the width of the leading surface; though confining the side surfaces entirely within the width of the leading surface is preferred. In addition, the leading, trailing and front surfaces can also be formed with non-planar shapes. In a front portion that is formed with curved surfaces, particularly a curved leading surface, there may be no clear delineation between the side surfaces and the leading surface. Side relief in accordance with the present invention could be provided in such instances if the side walls are positioned within the largest lateral width of the leading surface for more than half of the transverse distance between the foremost leading portion and the rearmost trailing portion of that portion of the tip provided with side relief (i.e., the distance between the leading and trailing surfaces and perpendicular to the longitudinal axis 60), and preferably more than about 75% of the distance.

Due the harsh environment during use, it is preferable to provide wear cap 40 with hardfacing. However, it has been determined that the most severe wearing occurs at the front of the tips and along a direction that is inclined to the longitudinal axis 160 of the tip. As a result, hardfacing need only be provided on the front portion 198 of wear cap 40 with its rear edge 1106 along an inclination generally parallel to the primary direction of the flow of the material relative to the tip (FIG. 16). In one preferred construction, the hardfacing is applied in an even band at an angle of about 70 degrees to axis 160, which is preferably parallel to front surface 1100. This limited use of hardfacing decreases the cost of the tip without any significant decrease in the useful life of the tip as compared to tips 11 with hardfacing over the entire cone 23.

Retainer 46 preferably includes a screw or male threaded member 1111 and a nut or female threaded member 1113 (FIGS. 1, 21, 22 and 27-29), though other kinds of retainers (with or without threads) could be used. Screw 1111 has a threaded shaft 1115 with a free end 1117, and a head 1119 with tool engaging means opposite free end 1117. Nut 1113 includes a threaded bore 1121 and a pair of flat outer sides 1123 to fit against flat sidewalls 199 in opening 197 to prevent rotation of the nut, though other non-circular shapes could be used. The nut is inserted into opening 197 from cavity 178. The nut can be retained in opening 197 by a flange on its inner end, by an interference fit with opening 197, by a corresponding narrowing of the nut and the opening, or other means. The use of such a nut enables opening 197 to be cast or otherwise formed without threads. Nonetheless, opening 197 could be formed with threads as an alternative. The threaded shaft 1115 of screw 1111 is threaded through bore 1121 for receipt into hole 174 to hold wear cap 40 to seat 144.

In a preferred embodiment, nut 1113 further includes a resilient member 1133 to contact screw 1111 and resist unwanted loosening during use. The resilient member is preferably a sleeve 1133 that surrounds shaft 1115. Sleeve 1133 resists unwanted loosening of screw 1111 during use, but permits retraction of screw 1111 when turned with a tool such as a torque wrench. Other arrangements could be used to resist loosening such as lock nuts, etc. Sleeve 1133 also works to seal opening 197 to lessen the embedding of fines among the threads of screw 1111 and nut 1113 and thereby ease the release of the lock. Sleeve 1133 is preferably formed of a polymer such as urethane, but could have other compositions as well.

Nut 1113 is preferably fitted in wear cap 40 during manufacture, but could be assembled by the operator. Likewise, screw 1111 is also preferably attached to the wear cap (i.e., by threading into nut 1113) so that the retainer 46 is integrally connected to the wear cap during manufacture as well. In this way, the proper fitting of nut 1113 in opening 197 and sleeve 1133 to screw 1111 can be assured. Moreover, in this way, retainer 46 always remains a part of the wear cap 40 so that there is no need to ship, store and keep track of a separate lock. The wear cap can be installed on the base with screw 1111 in nut 1113 provided free end 1117 does not project into cavity 178, though screw 1111 could be removed if desired. Once wear cap 40 is fully seated on seat 44, screw 1111 is advanced so that free end 1117 is received in hole 174 in adapter 37. Preferably, free end 1117 does not press against the bottom surface 1125 of hole 174, but it could be made to do so. Rather, head 1119 preferably includes a peripheral flange 1127 that is received into a counter bore 1129 in opening 197 to stop advancement of screw 1111 past this point. A larger counter bore 1131 is also provided in wear cap 40 to permit a tool to engage head 1119. Of course, other shapes and arrangements for nut 1113, screw 1111 and opening 197 could be used.

Figure 21:
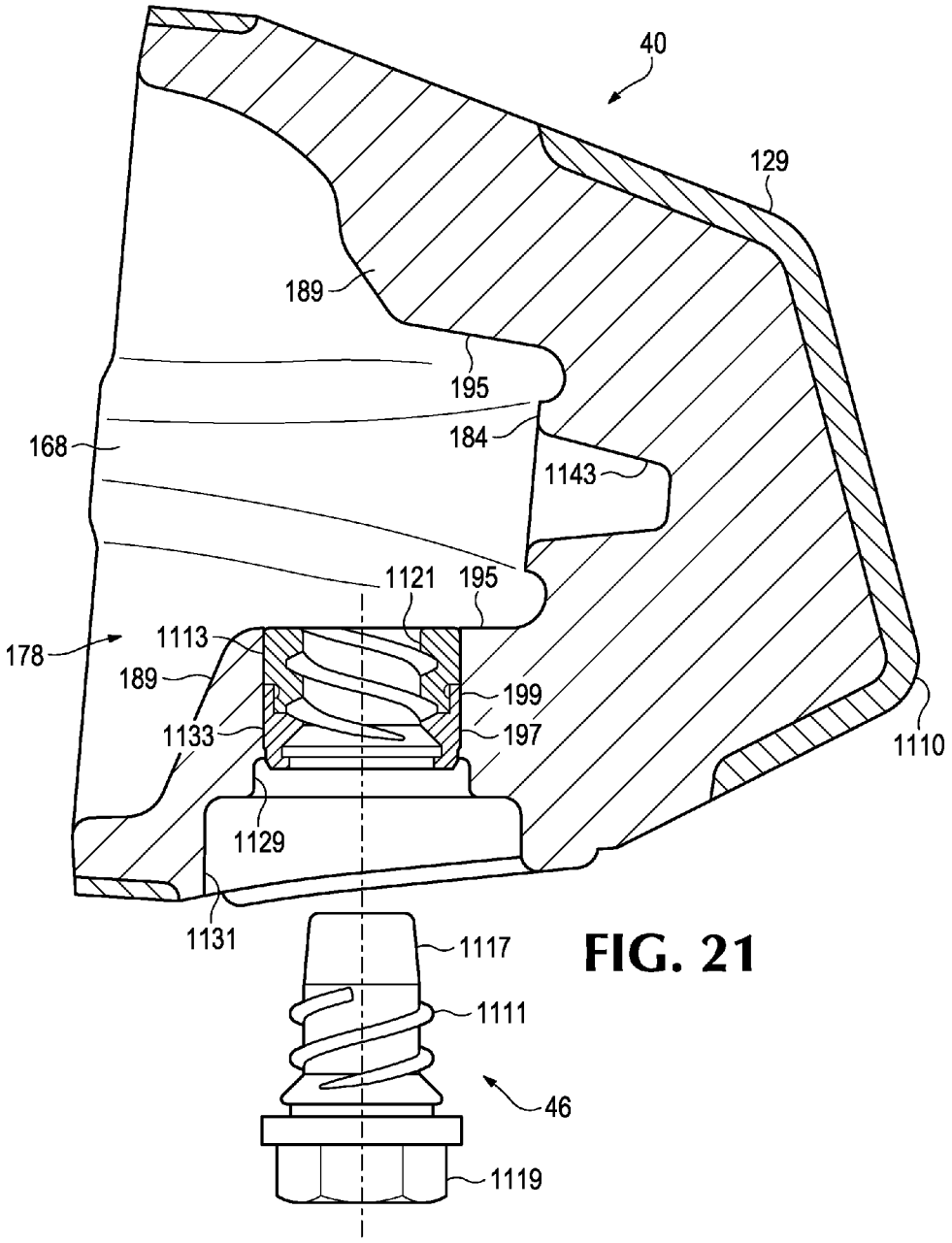
FIG. 21 is a longitudinal cross section of the wear cap with an exploded view of a retainer to hold the wear cap to the adapter.

A wear indicator 1143 preferably formed as a cavity extension forward of cavity 178 is provided to identify when the wear cap is spent and should be replaced (FIGS. 21 and 22). When wear cap 40 is to be replaced, screw 1111 is retracted or removed so that free end 1117 is moved out of hole 174. Wear cap 40 can then be pulled from seat 144. If embedded fines cause wear cap 40 to stick to seat 144, wear cap 40 can be pried forward from seat 144 with a standard pry tool (not shown).

Although preferred embodiments are described above, different aspects of the invention can be used in isolation to achieve some of the benefits of the invention. For example, a wide variety of different configurations could be used to form the cavity, the seat, the external wear surface, or the retainer and still achieve certain benefits of the invention.

The invention claimed is:

1. A wear assembly for an earth-working, driven roll comprising:

a base having a inner side configured for attachment to the driven roll to project out from the roll, and an outer side defining a support;

an adapter having a wearable surface including an upper surface and a pair of opposed sidewalls, a cavity opposite the wearable surface and open to receive the support in a first direction and mount the adapter to the base so as to shield the base from contact with earthen material during use, and a seat;

a wear cap having a pocket to receive the seat in a second direction generally transverse to the first direction and mount the wear cap on the adapter; and retainers to secure the adapter to the base and the wear cap to the adapter.

2. A wear assembly in accordance with claim 1 wherein the support includes a central rail and a stepped surface along each side of the rail, and the cavity has a first portion to receive the central rail and a second portion received over adjacent portions of the base.

3. A wear assembly in accordance with claim 1 wherein the support includes a hole, the adapter includes a hole in each said sidewall, the hole in the adapter extends into the cavity, and the hole in the support aligns with the holes in the adapter to receive one of the retainers to secure the adapter to the base.

4. A wear assembly in accordance with claim 3 wherein the support includes a forwardly-facing hook, and the adapter includes a rearwardly-facing hook that engages the hook on the support to secure the adapter in place on the base during use of the driven roll.

5. A wear assembly in accordance with claim 1 wherein the adapter overlies the entire outer side of the base.

6. A replaceable wear part for an earth-working, driven roll comprising (i) a mounting portion having a wearable surface facing generally away from the roll, the wearable surface including an outer wall and a pair of opposed sidewalls, a cavity opening opposite the outer wall of the wearable surface to receive in a first direction a complementary supporting portion on a base secured to the roll to shield the base from premature wear during use, and a hole for receiving a retainer and (ii) a contact portion projecting forward from the mounting portion in a second direction generally transverse to the first direction to contact earthen material as the roll is driven about an axis, the contact portion being rotationally spaced forward of the mounting portion and leading the movement of the wear part about the axis as the roll is driven.

7. A replaceable wear part in accordance with claim 6 wherein the contact portion and the mounting portion are separable parts secured together by a retainer.

8. A wear part in accordance with claim 6 including at least one rearwardly-facing hook to engage a forwardly-facing hook on a complementary supporting portion on the base.

9. A driven roll for an earth-working machine comprising:

a plurality of bases secured at selected locations around the outer surface of the driven roll, each said base having an inner surface secured to the roll to project out from the roll, and a support opposite the inner surface;

a plurality of replaceable wear parts each having a mounting portion with an outer wall, a pair of sidewalls, a cavity opening away from the outer wall to receive the support of one of the bases in a first direction, and a hole, and a contact portion projecting forward from the mounting portion in a second direction generally transverse to the first direction to contact the earthen material when the driven roll is used, and a plurality of retainers each received in said hole of one of the wear parts to secure the respective wear part to one of the bases.

10. A driven roll in accordance with claim 9 wherein the contact portion and the mounting portion for each wear part are separable parts secured together by a retainer.

11. A driven roll in accordance with claim 9 wherein the mounting portion of each wear part overlies the entire outer side of the corresponding base.

12. A driven roll in accordance with claim 9 wherein the support includes a central rail and a stepped surface along each side of the rail, and the cavity has a first portion to receive the central rail and a second portion received over adjacent portions of the base.

13. A driven roll in accordance with claim 9 wherein the support includes a forwardly-facing hook, and the replaceable wear part includes a rearwardly-facing hook that engages the hook on the support to secure the replaceable wear part in place on the base during use of the driven roll.

14. A roll crusher for crushing earthen material comprising:

at least one driven roll, a plurality of bases secured at selected locations around the outer surface of the driven roll, each said base having an inner surface secured to the roll to project out from the roll, and a support opposite the inner surface;

a plurality replaceable wear parts each having a mounting portion with an outer wall, a pair of sidewalls, a cavity opening away from the outer wall to receive the support in a first direction, and a hole, and a contact portion projecting forward from the mounting portion in a second direction generally transverse to the first direction to contact the earthen material when the driven roll is used, and a plurality of retainers each received in said hole of one of the wear parts to secure the respective wear part to one of the bases.

15. A roll crusher in accordance with claim 14 wherein the contact portion and the mounting portion for each wear part are separable components secured together by a retainer.

16. A roll crusher in accordance with claim 14 wherein the mounting portion of each wear part overlies the entire outer side of the corresponding base.

* * * * *